United States Patent [19]

Knoepke et al.

[11] Patent Number: 4,667,715

[45] Date of Patent: May 26, 1987

[54] METHOD FOR CONTROLLING UNIFORMITY OF ALLOY CONTENT IN CONTINUOUSLY CAST STEEL

[75] Inventors: John R. Knoepke; Howard M. Pielet, both of Munster; Larry A. Frank, Crown Point, all of Ind.; Daniel Rellis, Jr., Lansing, Ill.

[73] Assignee: Inland Steel Company, Chicago, Ill.

[21] Appl. No.: 805,707

[22] Filed: Dec. 6, 1985

[51] Int. Cl.[4] ..... B22D 11/10; B22D 11/16; B22D 11/18

[52] U.S. Cl. ..... 164/453; 164/452; 164/473

[58] Field of Search ..... 164/473, 451, 452, 453

[56] References Cited

U.S. PATENT DOCUMENTS

| | | | |
|---|---|---|---|
| 3,486,660 | 12/1969 | Heintz | 164/453 X |
| 3,528,479 | 9/1970 | Cole et al. | 164/453 X |
| 4,524,819 | 6/1985 | Yoshimura | 164/473 X |

FOREIGN PATENT DOCUMENTS

| | | | |
|---|---|---|---|
| 3003917 | 8/1980 | Fed. Rep. of Germany | 164/453 |
| 58-9756 | 1/1983 | Japan | 164/453 |
| 59-16661 | 1/1984 | Japan | 164/453 |

*Primary Examiner*—Nicholas P. Godici
*Assistant Examiner*—J. Reed Batten, Jr.
*Attorney, Agent, or Firm*—Marshall, O'Toole, Gerstein, Murray and Bicknell

[57] ABSTRACT

An alloying ingredient is added to molten steel entering the tundish in a continuous casting process. The concentration of the alloying ingredient is maintained substantially uniform throughout the cast by exercising certain controls. Small scale, short term variations in the mass flow rates of the alloying ingredient and molten steel and in the recovery of the alloying ingredient are attenuated by employing a system having certain characteristics.

16 Claims, No Drawings

METHOD FOR CONTROLLING UNIFORMITY OF ALLOY CONTENT IN CONTINUOUSLY CAST STEEL

BACKGROUND OF THE INVENTION

The present invention relates generally to methods for continuously casting steel and more particularly to such methods wherein the steel contains at least one alloying ingredient.

In a method for producing continuously cast steel, molten steel is introduced from a ladle into an intermediate container known as a tundish and then flowed through tundish exit nozzles into a continuous casting mold. Alloying ingredients such as lead and bismuth are added to the molten steel entering the tundish. Lead and bismuth have a relatively low solubility in molten steel and are heavier than molten steel.

Not all the alloying ingredient added to the molten steel is recovered. Accordingly, more alloying ingredient must be added to the molten steel than that which is desired in the final solidified steel, to reflect the fact that the recovery of these elements in the molten steel is less than 100%.

It is desirable that the concentration (Ca) of the alloying ingredient be substantially uniform throughout the cast. Permissibly, a variation in concentration (Ca) should be no greater than ±9%, and preferably no greater than ±5%. Maintaining such a uniformity in continuously cast steel is particularly desirable where the alloying ingredient has a relatively low solubility in molten steel and has a density greater than molten steel, as in the case of lead and bismuth, but such a uniformity is also desirable for any alloying ingredient added to continuously cast steel.

There are different stages and conditions occurring in the tundish during the casting operation. For example, the step of introducing the steel into the tundish comprises an initial stage, during which the tundish is being filled from a relatively empty condition, and a subsequent stage during which the tundish is relatively full. The mass flow rate (Fs) of the molten steel during the initial stage is greater than the mass flow rate (Fs) of the molten steel during the subsequent stage because it is desirable to fill the tundish as quickly as possible, and so the ladle nozzle, through which molten steel is flowed from the ladle to the tundish, is typically opened all the way during the initial stage of the steel-introducing step.

There are other process conditions or parameters involved in the continuous casting operation, and these include the temperature of the molten steel, the mixing energy to which the molten steel is subjected in the tundish, the residence time of the molten steel within the tundish, and the like.

SUMMARY OF THE INVENTION

The present invention provides a procedure for producing a substantially uniform concentration, throughout the cast, of alloying ingredients such as lead and bismuth or other alloying ingredients added to molten steel. It has been discovered, in accordance with the present invention, that the recovery for the alloying ingredient in the tundish can vary with changes in the stages of the steel introducing step and with changes in the process conditions or parameters during the casting operation. On the basis of previous casts, one can determine in advance the expected recovery (R) for the alloying ingredient for each of the several stages and conditions occurring in the tundish during the casting operation.

One can also determine the mass flow rate (Fs) at which molten steel is introduced into the tundish, throughout the casting operation.

In accordance with the present invention, both the expected recovery (R) for the alloying ingredient in the tundish, and the mass flow rate (Fs) at which the molten steel is introduced into the tundish, are determined. In addition, the mass flow rate (Fa) at which the alloying ingredient is added to the tundish is controlled so as to maintain, in accordance with the following formula, a substantially uniform concentration (Ca) of the alloying ingredient in the steel throughout the cast:

$$Ca = Fa \times R / Fs.$$

Further, in accordance with the present invention, (Fa) is adjusted at various times throughout the casting operation to compensate for changes in (Fs) and (R) occurring during the casting operation. As a result, the concentration (Ca) of the alloying element is controlled so that variations thereof do not exceed ±9% throughout the cast and preferably do not exceed ±5%.

The procedure described above is particularly useful to compensate for changes in (Fs) and (R) which are relatively large or are relatively long term. Relatively short term, relatively small variations in all three of (Fs), (R) and (Fa) can be offset by another expedient in accordance with the present invention. This expedient provides an attenuation of the variations described in the previous sentence by employing a relatively large volume fraction of well mixed molten steel in the tundish together with a relatively small time period for the variation and a relatively long mean residence time for the molten steel in the tundish.

Other features and advantages are inherent in the method claimed and disclosed or will become apparent to those skilled in the art from the following detailed description.

DETAILED DESCRIPTION

The present invention is applicable to assure a uniform concentration, in continuously cast steel, of virtually any alloying ingredient which one may desire to add to the steel, lead and/or bismuth being typical examples.

Lead and bismuth are added to molten steel to improve the machinability characteristics of the final solidified steel. Typical lead and bismuth contents in free machining steels are 0.05–0.50 wt.% lead and 0.04–0.40 wt.% bismuth.

When an alloying ingredient such as lead or bismuth is added to molten steel entering the tundish, the percentage of recovery in the tundish is not constant during the casting operation. It will vary with changes in the stages and conditions existing in the tundish during the casting operation. For example, the steel introducing step comprises an initial stage, during which the tundish is being filled from a relatively empty condition, and a subsequent stage during which the tundish is relatively full, and recovery of the lead or bismuth is different in the initial stage than it is in the subsequent stage.

On the basis of previous casts, one can determine the expected recovery (R) for the alloying ingredient in the tundish, for each of the several stages and conditions occurring during the casting operation. This can be accomplished by monitoring the amount of alloying ingredient added during the several stages and conditions occurring in each of a number of previous casts and chemically analyzing the particular portions of the solidified steel which were processed during the respective stages and conditions in those previous casts.

It is also possible, employing conventional expedients, to determine the mass flow rate (Fs) at which the molten steel is introduced into the tundish, throughout the casting operation. This can be accomplished by continuously monitoring the weight of the ladle from which the molten steel is introduced into the tundish and then calculating the mass flow rate (Fs) from the change in ladle weight.

In the case of lead and/or bismuth, the alloying ingredient may be added continuously to the stream of molten steel as it passes between the ladle and the tundish. Typically, this alloying ingredient may be directed toward the descending stream of molten steel by an inlet tube through which flows a mixture of alloying ingredient and transporting gas. The lead and/or bismuth alloying ingredient is preferably in the form of small shot particles having a diameter of about 1–2 mm. The alloying ingredient is introduced into the transporting gas from a hopper through a control valve which regulates the mass flow rate of the alloying ingredient. This mass flow rate (Fa) can be determined by continuously monitoring the weight of the hopper from which the alloying ingredient is introduced into the transporting gas and then calculating the mass flow rate from the change in hopper weight.

The present invention utilizes the factors and controls described above in a procedure for producing a substantially uniform concentration, throughout the cast, of the alloying ingredient. More particularly, the procedure comprises the step of determining in advance, on the basis of previous casts, the expected recovery (R) for the alloying ingredient, for each of the several stages and conditions occurring throughout the casting operation in the tundish. Another step in the procedure is determining the mass flow rate (Fs) at which the molten steel is introduced into the tundish, throughout the casting operation. An additional step comprises controlling the mass flow rate (Fa) at which the alloying ingredient is added to the tundish, so as to maintain, in accordance with the following formula, a substantially uniform concentration (Ca) of the alloying ingredient in the steel throughout the cast:

$$Ca=(Fa)\times(R)/(Fs).$$

The procedure further comprises adjusting the mass flow rate (Fa) of the alloying ingredient at various times throughout the casting operation to compensate for changes in (Fs) and (R) occurring during the casting operation. As a result, the concentration (Ca) can be controlled to within ±9% or better throughout the cast. The sum of the variations in (Fs), (Fa) and (R) should be no greater than the permissible variability of (Ca), namely ±9%, and preferably no greater than ±5%; and controls should be exercised to this end.

As noted above, the steel introducing step has an initial stage and a subsequent stage, and in the case of lead or bismuth the recovery of the alloying ingredient during the initial stage is greater than the recovery during the subsequent stage. In other words, the recovery will change from one stage to the next. Accordingly, in the case of lead, bismuth or the like, it is necessary to adjust the mass flow rate (Fa) of the alloying ingredient so that it is greater during the subsequent stage, in proportion to the mass flow rate (Fs) of molten steel, than it was during the initial stage. Absent such an adjustment of (Fa) there will be a change in recovery from the initial stage to the subsequent stage, and a corresponding variation in the concentration (Ca) of the alloying ingredient, which is undesirable. Typically, in the case of lead or bismuth, the mass flow rate (Fa) for the alloying ingredient, as a proportion of the mass flow rate (Fs) of the molten steel, during the initial stage of the steel introducing step, should be maintained 20–30% lower than the proportion during the subsequent stage.

It is desirable to maintain the recovery of the alloying ingredient relatively constant during the casting operation as this reduces the extent to which the mass flow rate (Fa) of the alloying ingredient must be adjusted in order to maintain a relatively uniform concentration (Ca) of the alloying ingredient in the cast steel product. As noted above, the recovery cannot be maintained constant from the initial stage to the subsequent stage of the steel introducing step. However, the expected recovery (R) for each of these two stages can be determined from previous casts, and the mass flow rate (Fa) of the alloying ingredient can be adjusted in accordance with the formula set forth above to maintain a uniform concentration (Ca) of alloying ingredient.

In order to minimize departures from the expected recovery (R), one should control or try to fix or maintain constant the other process conditions which affect the recovery of the alloying ingredient. These other process conditions comprise, for example, the temperature of the molten steel within the tundish, the extent to which the molten steel undergoes mixing in the tundish and the residence time of the molten steel in the tundish.

The extent of mixing to which the molten steel is subjected in the tundish depends principally upon the internal physical structure of the tundish. Since this is a constant, the extent of mixing to which the molten steel is subjected should not change, for a constancy in other processing conditions, unless outside factors which affect mixing are introduced.

An increase in residence time generally provides an increase in recovery. The residence time in the tundish can be controlled by controlling the volume percent of capacity to which the tundish is filled and is dependent upon the rate at which the molten steel is withdrawn from the tundish. The latter is a function of the opening size and number of exit nozzles in the tundish and can be fixed. Thus, the residence time can be controlled, at least during most of the subsequent stage of the steel introducing step, by maintaining a relatively constant level of molten steel in the tundish.

The temperature of the molten steel will vary as the casting operation proceeds. However, if external factors which affect the temperature are minimized, the temperature variation will follow an expected pattern and therefore will not cause a departure from the expected recovery (R) based on previous casts in which the external factors affecting temperature also were minimized.

Other factors which affect recovery and which should be controlled or fixed, to the extent possible, to minimize departures from the expected recovery (R), include: fuming by the alloying ingredient; the extent of surface area contact between undissolved alloying ingredient and the molten steel, per unit volume of alloying ingredient; and the position of the inlet tube for the alloying ingredient, in relation to the descending stream of molten steel entering the tundish. A method and apparatus useful in connection with controlling fuming and positioning the inlet tube are described in Rellis et al U.S. application No. 731,077, filed May 6, 1985, and now U.S. Pat. No. 4,602,949 issued July 29, 1986 and the disclosure thereof is incorporated herein by reference. The extent of surface area contact between undissolved alloying ingredient and molten steel depends upon the size of the globules of undissolved alloying ingredient which in turn depends upon the size of the shot particles initially introduced into the molten steel and upon the extent to which the undissolved alloying ingredient is subdivided or agglomerated by external factors, such as bubbling an inert gas through accumulations of undissolved alloying ingredient in the tundish.

In summary, the process conditions which affect the recovery of the alloying ingredient during a given stage are controlled or fixed to the extent possible so as to minimize departures from the expected recovery (R) during at least a major part of the cast. Desirably, the controls are exercised in a manner which maximizes recovery. In any event, the controls should have been put into use in the previous casts upon which expected recovery (R) is based and the same controls, exercised to the same extent, should be carried forward in time to the casts for which uniformity of concentration (Ca) of alloying ingredient is desired.

Adjusting the mass flow rate (Fa) of the alloying ingredient, in accordance with the considerations discussed above, is particularly useful to provide a uniform concentration of the alloying ingredient in the solidified steel, throughout the cast, for relatively large or long term variations in the expected recovery (R) of the alloying ingredient and in the mass flow rate (Fs) of the molten steel. There is another expedient employed in accordance with the present invention which will accommodate relatively small variations, for a relatively short period of time, in (R) and (Fs) as well as relatively small unintended variations, for a short period of time, in the mass flow rate (Fa) of the alloying ingredients. This expedient will also compensate for relatively small, relatively short term variations in recovery which are not expected on the basis of previous casts.

A relatively small variation in (Fa), (Fs) or (R) is one which, for a variation time period of about 3 minutes, will undergo an attenuation of at least 90% to produce a variation in (Ca) no greater than 9%. A relatively short term variation is generally one which lasts no more than about 3 minutes, preferably no more than 2 minutes.

In accordance with the present invention, short term variations in (Fa), (R) and (Fs) can be dampened or attenuated by controlling a number of factors, principally the mean residence time of the molten steel in the tundish, the volume fraction of well mixed molten steel in the tundish and the time period for the particular variation. The residence time of the molten steel in the tundish, in turn, is directly proportional to the volume of molten steel in the tundish (a function of the tundish size) and inversely proportional to the rate at which the molten steel is withdrawn from the tundish. The longer the residence time in the tundish, and the larger the volume fraction of well mixed molten steel in the tundish, the greater the attenuation of the variation. On the other hand, the longer the time period of the variation, the smaller the attenuation of the variation.

For a given tundish, the capacity thereof, the volume fraction of the molten steel therein which is well mixed and the casting speed or withdrawal rate are all generally fixed. Nevertheless, the mean residence time of the molten steel in the tundish can be maximized by maintaining the tundish filled to capacity as much as possible during the casting operation. Because the casting speed or withdrawal rate from the tundish is generally fixed, this factor cannot be decreased to increase residence time. However, if expedients are available to decrease the casting rate, this will increase the residence time and help promote increased attenuation.

That part of the variation which is not attenuated will show up downstream of the tundish, and it will be reflected as a variation in the concentration of the alloying ingredient in the solidified steel. Thus, if a variation is attenuated 90% in the tundish, 10% of the variation will show up downstream of the tundish.

The following table contains examples of the extent of attenuation for different time periods of variation for a typical tundish employed in accordance with the present invention. The tundish has a capacity of 46 Mg, 50% of the volume of which is well mixed. The other 50% of the volume constitutes so-called plug and dead volume wherein mixing does not occur. The casting speed or rate of withdrawal from the tundish is 3.6 Mg/min.

| TIME PERIOD OF VARIATION (MIN). | ATTENUATION (%) |
|---|---|
| 0.1 | 99.8 |
| 1.0 | 97.5 |
| 2.0 | 95.0 |
| 5.0 | 87.6 |
| 10.0 | 75.8 |
| 20.0 | 55.4 |

From the foregoing table, it can be seen that for the tundish described above, there is an attenuation of the variation of at least 95% for a variation time period of up to 2 minutes. This means that, downstream of the tundish, only 5% of the variation will appear. Generally speaking, the least permissible attenuation should be about 90%, 95% being preferable.

Reducing the time period of the variation will also increase attenuation. If the variation is in either of the two mass flow rates, (Fa) or (Fs), both of which can be continuously monitored, an adjustment is available to compensate for such a variation and thereby reduce its time period. An intentional adjustment of one of the two mass flow rates (Fa) or (Fs) will also require an adjustment of the other mass flow rate in order to assure a uniformity in the concentration of the alloying ingredients in accordance with the formula:

$$Ca=(Fa\times R)/Fs.$$

Because an adjustment in the variation of one mass flow rate requires a compensating adjustment in the other mass flow rate, such adjustments should preferably be avoided if the time period of the variation is relatively small, allowing the attenuation characteristics of the system to compensate for these short term variations. Accordingly, it is desirable to provide a system which will supply an attenuation of at least 90% and preferably 95% over a short period of time, e.g. 2–3 minutes.

There can be intentional adjustments to the mass flow rate (Fs) of the molten steel based on casting considerations unrelated to the uniformity of concentration (Ca)

of the alloying ingredient. Such adjustments are not transitory, and they usually produce a relatively long term variation in (Fs) or (R) of substantial size. Compensation for this type of variation in (Fs) or (R) requires an adjustment in (Fa) to provide the desired uniformity of concentration (Ca). The attenuation characteristics of the system will not suffice in such a situation.

As noted above, the present invention is particularly applicable to molten steel to which lead and/or bismuth had been added to improve the machinability of the steel. These include all steels to which lead and/or bismuth have heretofore been added for the purpose of improving machinability. These include steels which also contain, in addition to lead and/or bismuth, tellurium in alloying amounts (e.g. 0.02–0.06 wt.% tellurium).

The foregoing detailed description has been given for clearness of understanding only, and no unnecessary limitations should be understood therefrom, as modifications will be obvious to those skilled in the art.

We claim:

1. In a method for producing continuously cast steel having at least one alloying ingredient, wherein said method comprises the steps of introducing molten steel into a tundish, flowing said molten steel from daid tundish into a continuous casting mold, and adding said alloying ingredient to the molten steel entering said tundish, and wherein there are several stages and conditions occurring during the casting operation, a procedure for producing a substantially uniform concentration, throughout the casting operation, of said alloying ingredient, said procedure comprising the steps of:

determining in advance, on the basis of previous casting operations, the expected recovery (R) for said alloying ingredient in said tundish, for each of the several stages and conditions occurring during the casting operation;

determining the mass flow rate (Fs) at which said molten steel is introduced into said tundish, throughout the casting operation;

and controlling the mass flow rate (Fa) at which said alloying ingredient is added to said tundish, so as to maintain, in accordance with the following formula, a substantially uniform concentration (Ca) of said alloying ingredient in said steel throughout said cast:

$$Ca=(Fa\times R)/Fs:$$

said controlling step comprising adjusting said mass flow rate (Fa) at various times throughout said casting operation to compensate for changes in (Fs) and (R) occurring during the casting operation, whereby said concentration (Ca) varies no more than ±9% throughout said casting operation.

2. In a method as recited in claim 1 wherein:

said molten steel is introduced into said tundish from a ladle;

the weight of said ladle is continuously monitored;

and said mass flow rate (Fs) of said molten steel is determined by calculation from the change in said ladle weight.

3. In a method as recited in claim 1 wherein:

said step of adjusting the mass flow rate (Fa) is employed substantially only for (a) relatively large variations of (Fs) and (R), (b) relatively long term variations thereof and combinations of (a) and (b);

and said procedure comprises permitting relatively small variations of (Fa), (Fs) and (R) having relatively short terms to be compensated substantially solely by the attenuation characteristics of the casting system.

4. In a method as recited in claim 1 wherein:

said steel-introducing step comprises an initial stage, during which said tundish is being filled from a relatively empty condition, and a subsequent stage during which said tundish is relatively full;

said controlling step comprising adjusting said mass flow rate (Fa) for said alloying ingredient, as a proportion of the mass flow rate (Fs) of the molten steel, to a substantially different value, during said initial stage, than the proportion employed during said subsequent stage.

5. In a method as recited in claim 1 wherein:

said steel-introducing step comprises an initial stage, during which said tundish is being filled from a relatively empty condition, and a subseequent stage during which said tundish is relatively full;

said controlling step comprising adjusting said mass flow rate (Fa) for said alloying ingredient, as a proportion of the mass flow rate (Fs) of the molten steel, to a substantially lower value, during said initial stage, than the proportion employed during said subsequent stage.

6. In a method as recited in claim 5 wherein said alloying ingredient is at least one of lead and bismuth and wherein:

said proportion during said initial stage is 20–30% lower than during said subsequent stage.

7. In a method as recited in claim 1 wherein:

said steel-introducing step comprises an initial stage, during which said tundish is being filled from a relatively empty condition, and a subsequent stage after said initial stage;

and said procedure comprises controlling the process conditions which affect the recovery of said alloying ingredient during a given stage so as to minimize departures from said expected recovery (R) during at least a major part of the cast.

8. In a method as recited in claim 7 wherein said step of controlling said process conditions comprises:

maintaining a relatively constant level of molten steel in said tundish during said subsequent stage.

9. In a method as recited in claim 1 and comprising:

controlling variations in the flow rates of said molten steel (Fs) and said alloying ingredient (Fa) and in said expected recovery (R) so that the sum of their variations is no greater than the permissible variability of said concentration (Ca).

10. In a method as recited in claim 9 wherein:

said permissible variability of said concentration (Ca) is no greater than about ±5%.

11. In a method as recited in claim 1 wherein said alloying ingredient is at least one of lead and bismuth.

12. In a method as recited in claim 11 wherein said molten steel also includes tellurium.

13. In a method as recited in claim 1 wherein said method is performed in a tundish which has a capacity for a predetermined volume of molten metal, and is capable of providing, for that volume of molten metal, a predetermined well mixed fraction thereof, said procedure further comprising:

adjusting said mass flow rate (Fa) to compensate for relatively large variations in (Fs) and (R);

and attenuating relatively small variations in any of said mass flow rates and in the recovery of said alloying ingredient in said tundish by employing at least one of the following controls to produce an attenuation greater than 90%:

(a) increasing the mean residence time of the molten steel in the tundish; and (b) restricting the time period of the variation to no more than about 3 minutes.

14. In a method as recited in claim 13 wherein:

said time period for the variation is restricted to no more than 2 minutes;

and said variation is attenuated at least 95%.

15. In a method as recited in claim 13 wherein said control step of increasing said mean residence time of the molten steel in the tundish comprises at least one of the following sub-steps:

(a) increasing the volume of molten steel contained in said tundish; and (b) decreasing the rate at which molten steel is withdrawn from the tundish.

16. In a method as recited in claim 15 wherein:

said sub-step of increasing the volume of molten steel contained in the tundish comprises filling the tundish to capacity.

* * * * *